US006668789B1

(12) United States Patent
Marriott et al.

(10) Patent No.: US 6,668,789 B1
(45) Date of Patent: Dec. 30, 2003

(54) INTERNAL COMBUSTION ENGINE USING PREMIXED COMBUSTION OF STRATIFIED CHARGES

(75) Inventors: Craig D. Marriott, Rochester Hills, MI (US); Rolf D. Reitz, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 184 days.

(21) Appl. No.: 09/935,937

(22) Filed: Aug. 23, 2001

(51) Int. Cl.[7] ..... F02B 17/00
(52) U.S. Cl. ..... 123/295; 123/299
(58) Field of Search ..... 123/295, 299

(56) References Cited

U.S. PATENT DOCUMENTS

| | | | | | |
|---|---|---|---|---|---|
| 5,740,775 | A | * | 4/1998 | Suzuki et al. | 123/299 |
| 5,832,880 | A | | 11/1998 | Dickey | |
| 5,979,397 | A | * | 11/1999 | Machida et al. | 123/295 |
| 6,058,904 | A | * | 5/2000 | Kruse | 123/295 |
| 6,213,086 | B1 | | 4/2001 | Chmela et al. | |
| 6,230,683 | B1 | | 5/2001 | zur Loye et al. | |
| 6,253,728 | B1 | | 7/2001 | Matayoshi et al. | |
| 6,345,499 | B1 | * | 2/2002 | Nishimura et al. | 123/299 |
| 6,378,487 | B1 | * | 4/2002 | Zukouski et al. | 123/299 |
| 6,467,452 | B1 | * | 10/2002 | Duffy et al. | 123/299 |
| 6,499,458 | B1 | * | 12/2002 | Nieberding | 123/299 |
| 2001/0022168 | A1 | * | 9/2001 | Teraji et al. | 123/295 |
| 2001/0050068 | A1 | * | 12/2001 | Kruse | 123/295 |

FOREIGN PATENT DOCUMENTS

EP 1 077 321 A2 2/2001

OTHER PUBLICATIONS

Douville, B., Ouellette, P., Touchette, A., and URSU, B., "Performance and Emissions of a Two–Stroke Engine Fueled Using High–Pressure Direct Injection of Natural Gas", SAE paper 981160.

Dumitrescu, S., Hill, P. G., Li, G., and Ouellette, P., "Effects of Injection Changes on Efficiency and Emissions of a Diesel Engine Fueled by Direct Injection of Natural Gas", SAE paper 2000–01–1805.

Hill, P.G. and Douville, B., "Relating Burning Rate and $NO_x$ Formation to Pressure Development in Two–Stroke Diesel Engines", Journal of Energy Resources Technology, vol. 119, Jun. 1997.

Hodgins, K.B., Hill, P.G., Ouellette, P. and Hung, P., "Directly Injected Natural Gas Fueling of Diesel Engines", SAE Technical Paper No. 961671.

(List continued on next page.)

*Primary Examiner*—Erick Solis
(74) *Attorney, Agent, or Firm*—Craig A. Fieschko, Esq.; DeWitt Ross & Stevens S.C.

(57) ABSTRACT

During a combustion cycle, a first stoichiometrically lean fuel charge is injected well prior to top dead center, preferably during the intake stroke. This first fuel charge is substantially mixed with the combustion chamber air during subsequent motion of the piston towards top dead center. A subsequent fuel charge is then injected prior to top dead center to create a stratified, locally richer mixture (but still leaner than stoichiometric) within the combustion chamber. The locally rich region within the combustion chamber has sufficient fuel density to autoignite, and its self-ignition serves to activate ignition for the lean mixture existing within the remainder of the combustion chamber. Because the mixture within the combustion chamber is overall premixed and relatively lean, $NO_x$ and soot production are significantly diminished.

18 Claims, 1 Drawing Sheet

OTHER PUBLICATIONS

Kimura, S., Aoki, O., Muranaka, S., and Enomoto, Y., "New Combustion Concept for Ultra–Clean and High–Efficiency Small DI Diesel Engines", SAE paper 1999–01–3681.

Marriott, C., and Reitz, R., "An Experimental Investigation of Direct Injection for Homogeneous and Fuel–Stratified Compression Ignited Combustion", ILASS Americas 14th Annual Conference on Liquid Atomization and Spray Systems (Paper), May 2001, Dearborn, MI.

Marriott, C., "An Experimental Investigation of Direct Injection for Homogeneous and Fuel–Stratified Charge Compression Ignited Combustion Timing Control", University of Wisconsin–Madison Master's Thesis, May 2001.

Mtui, L.P. and Hill, P.G., Ignition Delay and Combustion Duration with Natural Gas Fueling of Diesel Engines, SAE Technical Paper No. 961933.

Ouellette, P., Douville, B., Hill, P.G., and URSU, B., "$NO_x$ reduction in a Directly Injected Natural Gas Engine", Proceedings of the 1998 Fall Technical Conference of the ASME Internal Combustion Engine Division, ICE vol. 31–3, Clymer, New York, USA, Sep. 1998.

SAE 1999–01–1284 Motronic MED7 for Gasoline Direct Injection Engines: Engine Management System and Calibration Procedures.

Tao, Y., Hodgins, K.B., and Hill, P.G., "$NO_x$ Emissions From a Diesel Engine Fueled with Natural Gas", Transactions of the ASME, vol. 117, Dec. 1995.

Unknown Author, "New European–built Almera", Automotive Engineering International Online: Global Viewpoints, Nov. 1999, p. 16 (from http://www.sae.org/automag/global-view$_{13}$11–99/16.htm).

* cited by examiner

INTERNAL COMBUSTION ENGINE USING PREMIXED COMBUSTION OF STRATIFIED CHARGES

STATEMENT REGARDING FEDERALLY SPONSORED RESEARCH

This invention was made with United States government support awarded by the following agencies: Department of Energy, Grant No. DOE DE-FG04-2000AL66549. The United States has certain rights in this invention.

FIELD OF THE INVENTION

This disclosure concerns an invention relating generally to reduction of emissions such as particulates and $NO_x$ in internal combustion engines, and more specifically to emissions reduction in compression ignition (CI or diesel) engines.

BACKGROUND OF THE INVENTION

Common pollutants arising from the use of internal combustion engines are nitrogen oxides (commonly denoted $NO_x$) and particulates (also known simply as "soot"). $NO_x$ is generally associated with high-temperature engine conditions, and may be reduced by use of measures such as exhaust gas recirculation (EGR), wherein the engine intake air is diluted with relatively inert exhaust gas (generally after cooling the exhaust gas). This reduces the oxygen in the combustion region and obtains a reduction in maximum combustion temperature, thereby deterring $NO_x$ formation. Particulates include a variety of matter such as elemental carbon, heavy hydrocarbons, hydrated sulfuric acid, and other large molecules, and are generally associated with incomplete combustion. Particulates can be reduced by increasing combustion and/or exhaust temperatures, or by providing more oxygen to promote oxidation of the soot particles. Unfortunately, measures which reduce $NO_x$ tend to increase particulate emissions, and measures which reduce particulates tend to increase $NO_x$ emissions, resulting in what is often termed the "soot-$NO_x$ tradeoff".

At the time of this writing, the diesel engine industry is facing stringent emissions legislation in the United States, and is struggling to find methods to meet government-imposed $NO_x$ and soot targets for the years 2002–2004 and even more strict standards to be phased in starting in 2007. One measure under consideration is use of exhaust after-treatment (e.g., particulate traps) for soot emissions control in both heavy-duty truck and automotive diesel engines. However, in order to meet mandated durability standards (e.g., 50,000 to 100,000 miles), the soot trap must be periodically regenerated (the trapped soot must be periodically re-burned). This requires considerable expense and complexity, since typically additional fuel must be mixed and ignited in the exhaust stream in order to oxidize the accumulated particulate deposits.

Apart from studies directed to after-treatment, there has also been intense interest in the more fundamental issue of how to reduce $NO_x$ and particulates generation from the combustion process and thereby obtain cleaner "engine out" emissions (i.e., emissions directly exiting the engine, prior to exhaust after-treatment or similar measures). Studies in this area relate to shaping combustion chambers, timing the fuel injection, tailoring the injection rate during injection so as to meet desired emissions standards, or modifying the mode of injection (e.g, modifying the injection spray pattern). One field of study relates to premixing methodologies, wherein the object is to attain more complete mixing of fuel and air in order to simultaneously reduce soot and $NO_x$ emissions. In diesel engines, the object of premixing methodologies is to move away from the diffusion burning mechanism which drives diesel combustion, and instead attempt to attain premixed burning. In diffusion burning, the oxidant (fuel) is provided to the oxidizer (air) with mixing and combustion occurring simultaneously. The fuel droplets within an injected spray plume have an outer reaction zone surrounding a fuel core which diminishes in size as it is consumed, and high soot production occurs at the high-temperature, fuel-rich spray core. In contrast, premixed burning mixes fuel and air prior to burning, and the more thorough mixing results in less soot production. Premixing may be performed by a number of different measures, such as by use of fumigation (injection of fuel into the intake airstream prior to its entry into the engine), and/or direct injection of a fuel charge relatively far before top dead center so that piston motion and convection within the cylinder result in greater mixing.

One promising diesel premixing technology is HCCI (Homogeneous Charge Compression Ignition), which has the objective of causing initial ignition of a lean, highly premixed air-fuel mixture near top dead center (near the end of the compression stroke or the beginning of the power stroke). An extensive discussion on HCCI and similar premixing techniques is provided in U.S. Pat. No. 6,230,683 to zur Loye et al., and U.S. Pat. No. 5,832,880 to Dickey and U.S. Pat. No. 6,213,086 to Chmela et al. also contain useful background information. The charge is thus said to be "homogeneous" in HCCI because it is (at least theoretically) highly and evenly mixed with the air in the cylinder. Ignition is then initiated by autoignition, i.e., thermodynamic ignition via compression heating. The objective is to use autoignition of the lean mix to provide significantly lower combustion chamber temperatures, thereby diminishing $NO_x$ production (which thrives at high temperature). In contrast, a richer mixture (such as that necessary for flame propagation from the spark in an SI engine) will burn more quickly at greater temperature, and therefore may result in greater $NO_x$ production.

As the foregoing references note, while the HCCI process might be beneficially implemented, it is also hard to accomplish owing to the difficulties in igniting the lean mix and/or controlling the start of ignition. Combustion in an SI engine is readily initiated by the spark, with premixed burning occurring afterward; similarly, combustion in a conventional CI engine is initiated by fuel injection near top dead center (following compression) when thermodynamic conditions for autoignition are favorable, with diffusion burning occurring afterward. However, HCCI does not utilize a spark, nor is it desirable to use the rich mixture needed for effective use of a spark. It is also difficult for HCCI to achieve a homogeneous charge or premixed burning if injection near top dead center (during or after compression) is used, since there is less time for mixing to occur. Thus, a key area of study in the HCCI field is how and when to efficiently initiate ignition, and ignition and timing problems are the primary reason why HCCI has not attained widespread use.

Multiple injection, also called split injection, pilot injection, and post injection, has also been a proposed method for $NO_x$ and particulate emissions reduction in diesel engines (see, e.g., Tow, T., Pierpont, A. and Reitz, R. D. "Reducing Particulates and $NO_x$ Emissions by Using Multiple Injections in a Heavy Duty 0.1. Diesel Engine, " SAE Paper 940897, SAE Transactions, Vol. 103, Section 3, Journal of Engines, pp. 1403–1417, 1994). A multiple injection engine varies from the standard "single injection" engine in that the direct injection of a single fuel charge during the combustion cycle is replaced by direct injection of several fuel charges spaced over time, with less fuel being used per injection so that the total amount of fuel finally injected per cycle is comparable to that used in single injection. The multiple injections take place around top dead center (after compression), and burning occurs in a diffusion mode wherein each charge burns upon injection, without premixing. Thus, the division of the "standard" single injected charge into several smaller discrete charges spaced over time results in steady and more complete burning of the injected fuel plumes with more evenly maintained combustion temperature, which helps decrease emissions. While multiple injection is not in common use at the time of this writing, engines using the multiple injection concept are now in production or under development in Europe, Japan and the United States.

Further, while multiple injection will assist the diesel engine industry in meeting emissions goals, it unfortunately does not appear to be a complete solution: it does not by itself decrease emissions to the minimum levels desired. There is thus a significant need for methods and apparata which assist in compression ignition or diesel engine emissions reduction.

SUMMARY OF THE INVENTION

The invention involves a premixing methodology which is intended to at least partially solve the aforementioned problems. To give the reader a basic understanding of some of the advantageous features of the invention, following is a brief summary of preferred versions. As this is merely a summary, it should be understood that more details regarding the preferred versions may be found in the Detailed Description set forth elsewhere in this document. The claims set forth at the end of this document then define the various versions of the invention in which exclusive rights are secured.

During a combustion cycle, a first stoichiometrically lean fuel charge is injected long prior to the intended time of ignition, preferably at any time between top dead center and bottom dead center during the intake stroke, or after bottom dead center and early in the compression stroke. Injection of the first fuel charge during the intake stroke is particularly preferred. As the piston progresses towards bottom dead center, the motion of the piston and the cylinder gases provides a high degree of mixing of the first fuel charge and the air within the cylinder, resulting in a more homogeneous fuel/air mixture.

Prior to the time when ignition is desired, a subsequent fuel charge is injected to create a stratified, locally richer mixture (but still leaner than stoichiometric). While this injection may occur at almost any time during the compression stroke depending on speed and load conditions (generally between a time shortly after bottom dead center and a time shortly prior to top dead center), later injection is more desirable since it provides lesser mixing time and motion, thereby enhancing stratification. The locally rich region within the combustion chamber has sufficient fuel density to autoignite (for example, it may constitute the remaining 50–20% of the "standard" charge), and its self-ignition serves to activate ignition for the lean mixture existing within the remainder of the combustion chamber. Because of the use of HCCI combustion conditions within the major portion of the combustion chamber—i.e., a premixed and overall relatively lean mixture—$NO_x$ and soot are significantly diminished.

It can be appreciated that the invention is more than an evident extension of HCCI concepts. Common HCCI methods seek to attain an extremely high degree of premixing, with the objective of producing an entirely homogeneous charge within the combustion chamber prior to the desired time of ignition (which is difficult to control, as previously noted). In contrast, while the present invention seeks to attain some degree of premixing with the first charge (with this charge being desirably, though not necessarily, homogeneously dispersed throughout the combustion chamber), the later injection largely obviates homogeneity by creating a highly stratified, locally richer ignition region within the combustion chamber. It can also be appreciated that while the invention utilizes the concept of multiple injection, it does not use it for the purpose for which multiple injections are generally intended. Standard diesel multiple injection methodologies have an initial fuel charge injected and ignited at or slightly before top dead center during the compression stroke, and then follow with subsequent injections spaced over time to maintain a controlled combustion rate. Combustion occurs via a diffusion burning mechanism, whereby each injection is burned at the time of injection. In contrast, the first injection in the present invention is done relatively far before top dead center during compression (and is not immediately ignited), and a subsequent injection is done shortly prior to top dead center during compression, with the objective of initiating premixed burning throughout the entirety of the combustion chamber. Thus, the invention is more than a simple amalgamation of HCCI and multiple injection concepts.

Further advantages, features, and objects of the invention will be apparent from the following detailed description of the invention in conjunction with the associated drawings.

DETAILED DESCRIPTION OF THE INVENTION

Figure 1:
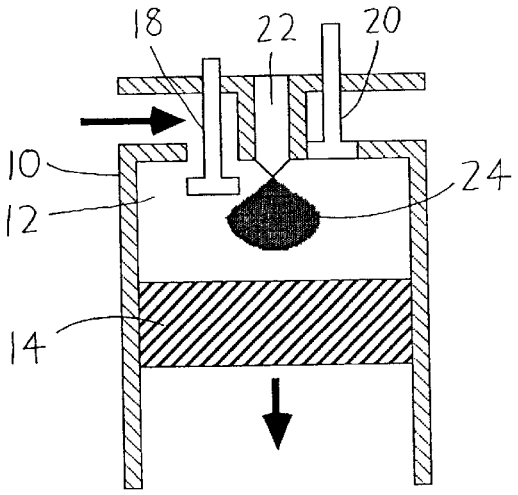
FIG. 1 is a sectional view of a combustion chamber 12 taken along the axis along which the piston 14 moves, illustrating the piston 14 moving away from top dead center during the intake stroke, at which point a first injection 24 is made.

A preferred version of the invention will be described with reference to the exemplary internal combustion engine cylinder 10 illustrated in FIGS. 1–4. It should be understood that the drawings depict an exemplary idealized cylinder 10, and the invention may be implemented in engines having radically different configurations than the one shown.

Within the cylinder 10, a combustion chamber 12 is defined between a piston 14 and the cylinder internal walls 16. An inlet valve 18 may be opened to allow entry of air, and an exhaust valve 20 may be opened to allow ejection of exhaust gases after combustion occurs. The exhaust valve 20 is shown closed throughout the Figures because an exhaust stroke is not depicted. It should be understood that in some engines wherein the invention may be implemented, there may be only a single valve which provides both inlet and exhaust functions, or there may be additional inlet and/or exhaust valves. A fuel injector 22 is provided to inject fuel charges into the combustion chamber 12 at desired times.

Referring specifically to FIG. 1, the piston 14 is shown moving away from top dead center near the beginning of the intake stroke. As previously noted, the invention preferably injects a first injection 24 long prior to the desired time of ignition so that the first injection 24 has time to at least substantially homogeneously disperse throughout the combustion chamber 12; here, the first injection 24 is made near the start of the intake stroke (indicated by the open inlet valve 18), though it may occur as late as sometime early in the compression stroke. The objective is to provide the first injection 24 early enough that it will at least substantially homogeneously disperse throughout the combustion chamber 12, and since mixing is enhanced by the motion of the piston 14 and the air within the combustion chamber 12, earlier injection will often be beneficial. However, since mixing characteristics will vary widely between different engines depending on engine configuration, operating speed, etc., it should be appreciated that some engines may be able to obtain substantially homogeneous dispersion with later injection.

If the first injection charge 24 generates a rich enough fuel/air mixture, it might uncontrollably autoignite during compression under some speeds/loads. This is undesirable since uncontrolled autoignition can greatly diminish power and engine efficiency, and it causes rapid burning with a high (and $NO_x$-promoting) heat release rate. Thus, the first charge 24 preferably contains most of the fuel to be consumed during the current combustion cycle, but is sufficiently lean that it is at least slightly below the threshold for autoignition; for example, it may be 50–80% or so of a "standard" charge (i.e., one in an HCCI engine which does not implement the invention).

Figure 2:
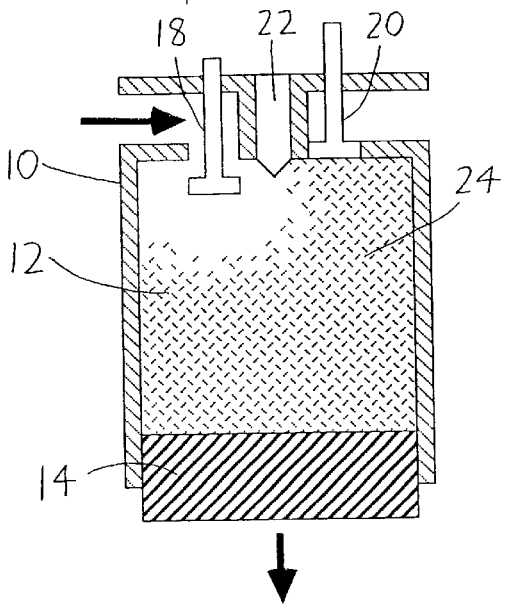
FIG. 2 illustrates the piston 14 near bottom dead center and the end of the intake stroke, at which point the first injection 24 has at least begun to disperse throughout the combustion chamber 12.

FIG. 2 then illustrates the piston 14 near bottom dead center at the end of the intake stroke, shortly prior to closing the inlet valve 18 and starting the compression stroke. At this point, the first injection charge 24 has at least begun to disperse throughout the combustion chamber 12, with FIG. 2 depicting a more unmixed region near the inlet valve 18 since air is still entering the combustion chamber 12. The entering air and the motion of the piston 14 assist in dispersing the first injection charge 24 about the combustion chamber 12.

Figure 3:
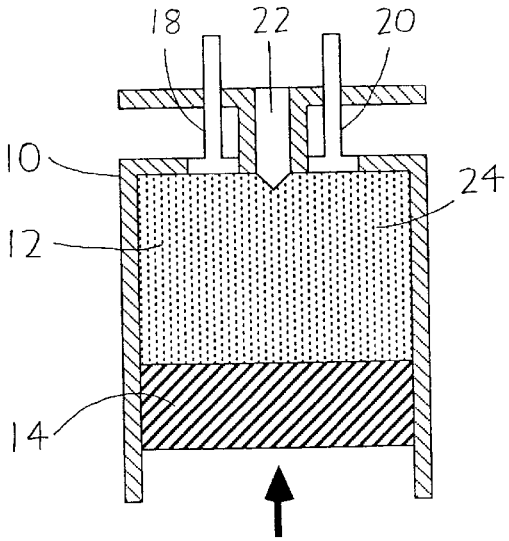
FIG. 3 illustrates the piston 14 during the compression stroke, with the first injection 24 continuing to distribute homogeneously throughout the combustion chamber 12.
Figure 4:
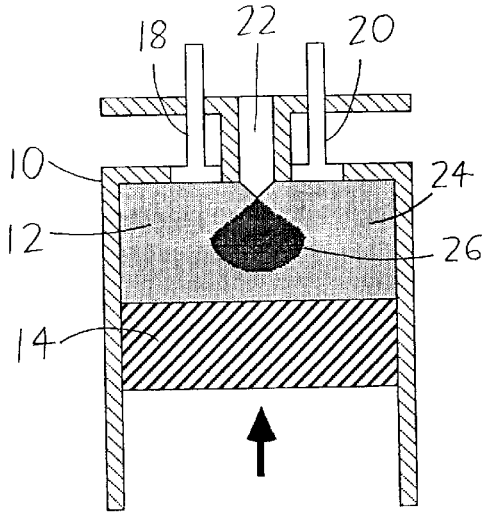
FIG. 4 illustrates the piston 14 during the compression stroke at a time subsequent to that of FIG. 3, at which point the first injection 24 has experienced even further mixing, and wherein an igniting charge 26 is injected into the combustion chamber 12 to define a locally richer (but still stoichiometrically lean) region suitable for autoignition (either at the time of injection, or shortly thereafter so that some premixing occurs prior to autoignition).

FIG. 3 illustrates the piston 14 near the beginning of the compression stroke. The inlet valve 18 has closed and the first injection 24 is continuing to homogeneously disperse throughout the combustion chamber 12. As depicted in FIG. 4, shortly before the desired time for initiating ignition, an igniting charge 26 is injected into the combustion chamber 12 to define a stratified region which is by itself lean, but which generates a locally rich (but still stoichiometrically lean) region suitable for autoignition when the appropriate thermodynamic conditions are reached during compression. The igniting charge 26 thereby promotes ignition of the first injection charge 24 as well, which by this time preferably exists as an at least substantially homogeneous fuel-air mixture throughout the combustion chamber 12. Since the first injection 24 provides a lean and at least substantially premixed fuel-air mixture throughout the majority of the combustion chamber 12, with combustion of this mixture primarily being initiated by the igniting charge 26, the combustion products have low $NO_x$ and soot content. While similar results can be achieved with HCCI, the common HCCI problem of ignition timing is avoided since the injection of the igniting charge 26 serves as the initiating event, and such injection is easily timed when desired.

It is noted that the injection timing of the later ignition-triggering charge is primarily dictated by the desire to generate a locally rich (but still stoichiometrically lean) fuel-air region within the combustion chamber, with this stratified region also preferably being at least partially premixed. Thus, very early injection of the igniting charge is undesirable because of the possibility that full mixing may occur throughout the combustion chamber (i.e., the stratified region might be erased by mixing), but very late injection is also preferably avoided because this deters premixing. If injection of the igniting charge is too late, the injected fuel may impinge on the piston or otherwise remain in the chamber in large-diameter droplets or other more massive forms, and may fail to vaporize until combustion is underway. Even if the fuel does not impinge on the piston, very late injection still may not provide sufficient time to vaporize the fuel before combustion ensues. In either case, if unvaporized (large-droplet) fuel remains in the cylinder after combustion ensues, diffusion burning and high soot production will result. To achieve a locally rich and premixed region, the later igniting charge is preferably injected sufficiently late that stratification is maintained, but early enough that nearly all of the fuel vaporizes and mixes with air to some degree prior to combustion.

Advantageously, a CI engine which implements the invention may use either diesel (CI-formulated) fuel or gasoline (SI-formulated fuel), with the former possibly providing advantageous performance at higher load conditions where burning a lean gasoline/SI mixture might not provide the desired degree of power. As is well known, diesel fuels are formulated to promote autoignition, whereas SI fuels are formulated to avoid it so as to prevent the occurrence of knock. Thus, it should be appreciated that depending on the type of fuel used, as well as the configuration of the specific engine involved, the distribution of fuel between the first and subsequent charges may vary drastically from engine to engine, as well as the timing and spray characteristics of such charges.

The invention is expected to be of use not only in 4-stroke CI engines, but also in 2-stroke CI engines, rotary CI engines, and other types of compression ignition and/or hybrid CI/SI engines. The invention is also useful in SI engines, though it would probably require the use of richer mixtures in order to ensure sufficient flame propagation for adequate combustion. Nevertheless, if an SI engine implements the invention by coupling initial premixing of a lean mixture, later injection to create a locally rich mixture, and spark ignition of the locally rich mixture to activate ignition throughout the entire combustion chamber, the invention might allow the SI engine to utilize a greater compression ratio than might otherwise be feasible, thereby enhancing efficiency. A higher compression ratio ordinarily enhances the possibility of detrimental knock (preignition), but in this case, the use of a sufficiently lean mixture within the combustion chamber may deter knock until the time of desired ignition.

Further details regarding the invention can be found in the paper "An Experimental Investigation of Direct Injection for Homogeneous and Fuel-Stratified Compression Ignited Combustion", Craig D. Marriott and Rolf D. Reitz, ILASS Americas, 14th Annual Conference on Liquid Atomization and Spray Systems, Dearborn, Mich. (May 2001). Inventor Craig Marriott's University of Wisconsin-Madison Master's Thesis "An Experimental Investigation of Direct Injection for Homogeneous and Fuel-Stratified Compression Ignited Combustion Timing Control" (2001) provides further information. These papers, which are hereby incorporated by reference, may be available from the Engine Research Center of the University of Wisconsin-Madison (Madison, Wis., USA).

Various preferred versions of the invention are shown and described above to illustrate different possible features of the invention and the varying ways in which these features may be combined. Apart from combining the different features of the different versions in varying ways, other modifications are also considered to be within the scope of the invention. Following is an exemplary list of such modifications.

First, it may be possible to provide greater mixing if several charges are injected prior to the ignition-generating charge (which will generally, but not necessarily, be the final injected charge). Thus, the invention should not be regarded as limited to solely a first premixing charge and a second ignition-generating charge.

Second, while it is preferable to have the first charge(s) result in a well-mixed fuel-air mixture which is resistant to autoignition (with the later ignition-generating charge then initiating the overall ignition event), the first charge(s) may instead provide a mixture which is sufficiently rich that it is slightly above the autoignition threshold. In this case, the earlier charge(s) should provide a mix which is still sufficiently lean that any autoignition results in slow and highly incomplete combustion. Injection of the final charge may then initiate more complete combustion of the prior charge (s) throughout the entirety of the combustion chamber.

Third, further benefits might be obtained if the invention is implemented with other known means for reducing emissions or otherwise enhancing engine performance. As an example, catalytic exhaust aftertreatment can help diminish hydrocarbon and carbon monoxide emissions.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A method comprising:

a. injecting a first fuel charge into a combustion chamber during the intake or compression stroke of a combustion cycle of an internal combustion engine;

b. injecting an intermediate fuel charge after the first fuel charge;

c. thereafter injecting a subsequent fuel charge into the combustion chamber during the compression stroke, wherein ignition is initiated by injection of the subsequent fuel charge.

2. The method of claim 1 wherein the first fuel charge is injected during the intake stroke.

3. The method of claim 1 wherein the subsequent fuel charge is the final one injected prior to the following intake stoke.

4. The method of claim 1 wherein a stoichiometrically lean mixture exists within the combustion chamber after injection of the first fuel charge.

5. The method of claim 4 wherein a stoichiometrically lean mixture exists within the combustion chamber after injection of the subsequent fuel charge.

6. The method of claim 1 wherein the first fuel charge contains at least 50% of the fuel provided within the combustion chamber prior to ignition.

7. The method of claim 1 wherein a stoichiometrically lean mixture exists within the combustion chamber after injection of the subsequent fuel charge.

8. The method of claim 1 wherein the intermediate fuel charge results in a stoichiometrically lean mixture within the combustion chamber.

9. The method of claim 1 wherein the subsequent fuel charge contains less than 50% of the fuel within the combustion chamber prior to autoignition.

10. The method of claim 2 wherein the subsequent fuel charge is the final one injected prior to the following intake stroke.

11. The method of claim 4 wherein a stoichiometrically lean mixture exists within the combustion chamber after injection of the intermediate fuel charge.

12. The method of claim 11 wherein a stoichiometrically lean mixture exists within the combustion chamber after injection of the subsequent fuel charge.

13. The method of claim 12 wherein the subsequent fuel charge is the final one injected prior to the following intake stroke.

14. A method comprising:

a. injecting a first fuel charge into a combustion chamber during an intake stroke, the first fuel charge resulting in a stoichiometrically lean mixture within the combustion chamber;

b. injecting an intermediate fuel charge after the first fuel charge;

c. thereafter injecting a subsequent fuel charge into the combustion chamber during the following compression stroke, the subsequent fuel charge resulting in a stoichiometrically lean mixture within the combustion chamber, wherein ignition is initiated by injection of the subsequent fuel charge.

15. The method of claim 14 wherein the subsequent fuel charge contains less fuel than the first fuel charge.

16. The method of claim 14 wherein the first fuel charge contains at least 50% of the fuel provided within the combustion chamber prior to ignition.

17. The method of claim 14 wherein the subsequent fuel charge contains less than 50% of the fuel within the combustion chamber prior to autoignition.

18. The method of claim 14 wherein the subsequent fuel charge is the final one injected prior to the following intake stroke.

* * * * *